US005363576A

United States Patent [19]

Piana et al.

[11] Patent Number: 5,363,576

[45] Date of Patent: Nov. 15, 1994

[54] SUPPORT FOR ELECTRIC CABLE AND WIRE MARKING WITH CLOSED, PARTIALLY NOTCHED SLEEVE

[75] Inventors: Ivana Piana; Silvano Piana, both of Genova, Italy

[73] Assignee: Graphoplast S.p.A., Italy

[21] Appl. No.: 709,063

[22] Filed: May 30, 1991

Related U.S. Application Data

[63] Continuation of Ser. No. 508,092, Apr. 10, 1990, abandoned.

[30] Foreign Application Priority Data

Apr. 14, 1989 [IT] Italy ..... 12477 A/89

[51] Int. Cl.[5] ..... G09F 3/00

[52] U.S. Cl. ..... 40/316; 40/665

[58] Field of Search ..... 40/316, 306, 309, 317, 40/322, 334, 665; 24/205, 17 B, 20 R, 16 PB

[56] References Cited

U.S. PATENT DOCUMENTS

| | | | |
|---|---|---|---|
| 345,767 | 7/1886 | Buckley | 24/391 X |
| 1,305,245 | 6/1919 | Barthelemy | 40/334 |
| 1,965,068 | 7/1934 | Chesler | 40/334 |
| 2,859,547 | 11/1958 | Davidson et al. | 40/309 |
| 3,068,600 | 12/1962 | Blanchet | 40/316 |
| 3,534,777 | 11/1970 | Loof | 40/316 X |
| 4,033,057 | 7/1977 | Jaffe | 40/665 |
| 4,045,899 | 9/1977 | Richardson | 40/322 |
| 4,123,864 | 11/1978 | Batts et al. | 40/316 |
| 4,234,090 | 11/1980 | Barbieri et al. | 40/316 X |
| 4,471,547 | 9/1984 | Kaslow | 40/309 |
| 4,843,686 | 7/1989 | Bartholomew | 24/20 R X |
| 4,844,000 | 7/1989 | Clement | 40/316 X |
| 4,910,832 | 3/1990 | Schaub et al. | 24/205 X |

FOREIGN PATENT DOCUMENTS

| | | | |
|---|---|---|---|
| 683012 | 6/1930 | France | 40/665 |
| 2430643 | 2/1980 | France . | |
| 1039122 | 8/1966 | United Kingdom | 40/316 |

*Primary Examiner*—Brian K. Green
*Attorney, Agent, or Firm*—Rosenman & Colin

[57] ABSTRACT

A closed sleeve support for cable marking has two or more consecutive and lengthwise opposed partial notches adapted to spread apart and accomodate cables having a wide diameter range, due to elastic opening of the notches.

14 Claims, 2 Drawing Sheets

FIG.1
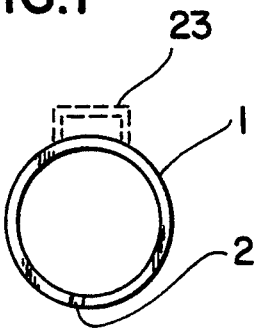
FIG.2
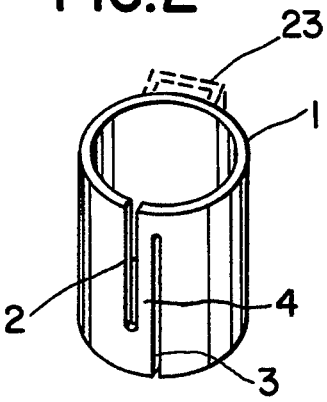
FIG.3
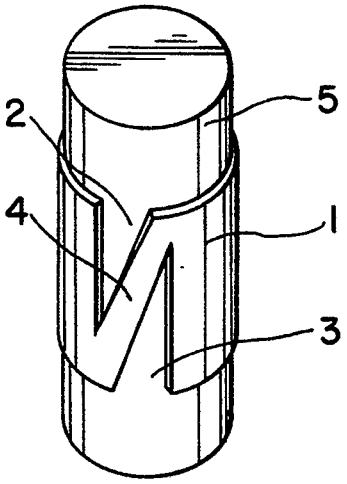
FIG.4
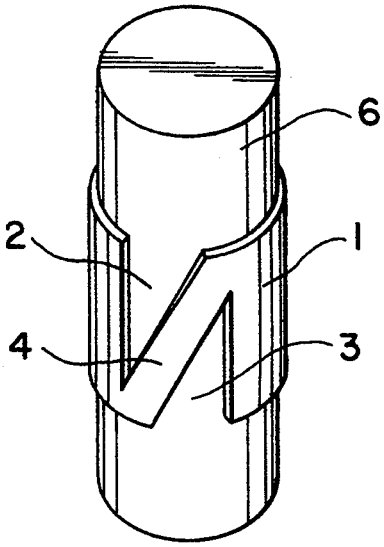
FIG.5
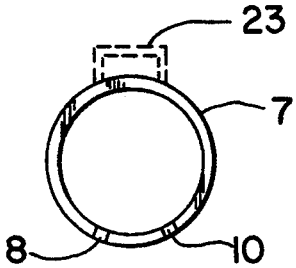
FIG.6
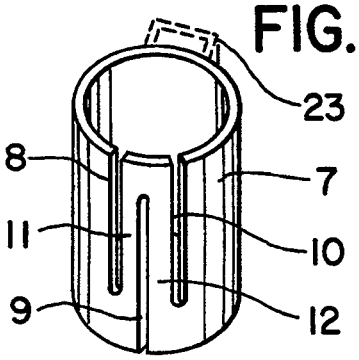
FIG.8
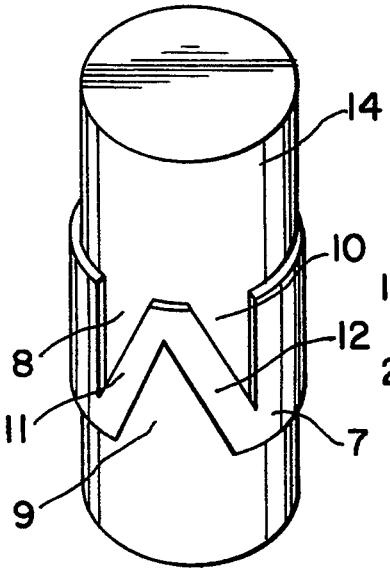
FIG.9
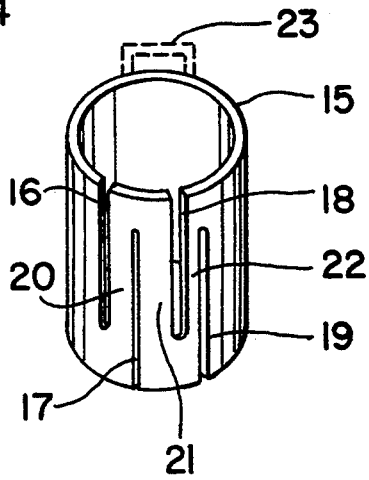
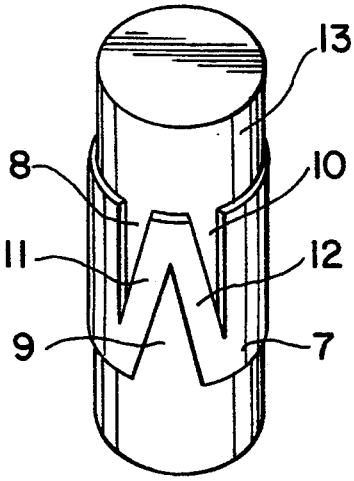
FIG.7

SUPPORT FOR ELECTRIC CABLE AND WIRE MARKING WITH CLOSED, PARTIALLY NOTCHED SLEEVE

This is a continuation of application Ser. No. 07/508,092, filed Apr. 10, 1990, now abandoned.

BACKGROUND OF THE INVENTION

1. Field of the Invention

The invention relates to sleeve type supports for electric wire and cable marking.

2. Description of Related Art

Numerous closed sleeve supports for electric cable marking are already known, as well as lengthwise cut or C-shaped sleeves.

Particularly well known closed type sleeve supports are shown in GB-A-960278 and CH-A-607245. Among the C-shaped sleeves, the solutions according EP-A-0121454, U.S. Pat. No. 428,986 and DE-C-655749 are best known.

All these known solutions essentially differ in their approach to facilitate installation and improve the stability of the sleeves on the cable.

Usually, closed sleeve supports have peripheral bends or internal tabs pressing on the cable to ensure stable positioning of the support whereas C-shaped sleeves may have various features to improve their wrapping around the cable by means of the two open ends of the sleeve.

Furthermore, several cable marking systems are known, for instance using codes preprinted on the sleeve or printed on labels glued onto the sleeve or similar systems. A cable marking system is also known by which ring-shaped marking elements are introduced in a recess on the outside of the support.

SUMMARY OF THE INVENTION

This invention concerns a closed sleeve support. A simple closed sleeve around the cable would obviously ensure excellent stability if its inside diameter were slightly smaller than the outside diameter of the cable, but it would be impossible to fit such a sleeve on the cable. In practice, the closed sleeve has therefore an inside diameter which is much larger than the outside diameter of the cable, while adhesion is achieved by peripheral accordion folds elastic inward bent flanges so as to cause friction between the sleeve and the cable in order to guarantee a steady positioning.

It follows, that such sleeves take up much space and this may cause trouble when marking small sized cables laid in bundles or near to each other.

Normally, the stability of such accordion folded flange fitted sleeves is not very good due to the poor contact between the support and the cable which is limited to horizontal lines with the further drawback that such sleeves can be fitted only on cables having the same diameter as the sleeve or having a slightly different size. Therefore, the operator in charge of cable marking needs a large number of sleeves to match the cable diameters.

These problems have led to the adoption of C-shaped sleeves of various types which ensure fair stability and adjustment to cables in a relatively large diameter range. The present invention has the object of improving the stability of closed sleeve supports when installed on the cables and to make them even more stable than open C-shaped sleeves. Furthermore, the invention will permit the same closed sleeve on differently sized cables in a rather larger diameter range, while minimizing their dimensional requirements.

In accordance with the invention there is provided a closed sleeve for cable marking in which the sleeve has two or more partial notches which are partially closed and pointing lengthwise in opposite directions. When these sleeves are fitted on the cables, their notches will permit them to expand until they match the cable diameter, but in practice, the inner sleeve surface will press against the cable surface thus ensuring great stability. The widening of the notches will permit the use of the same size of sleeve for various cable diameters while maintaining the above mentioned excellent stability.

Furthermore, the dimensional requirements of this sleeve are limited to its wall thickness only and will therefore not hinder wire marking, even though the cables are very small and are laid side by side.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention in the drawings.

BRIEF DESCRIPTION OF THE DRAWINGS

FIG. 1 is a top view of a closed sleeve support provided with two partial notches, in accordance with the invention;

FIG. 2 is a perspective view of the support illustrated in FIG. 1;

FIGS. 3 and 4 show perspective views of the support illustrated in FIG. 2, mounted on cables having different diameters;

FIG. 5 is a top view of a closed sleeve support featuring three lengthwise opposed alternating notches;

FIG. 6 is a perspective view of the sleeve illustrated in FIG. 5;

FIGS. 7 and 8 are perspective views of the support illustrated in FIG. 6 fitted on cables having different diameters;

FIG. 9 shows a perspective view of a sleeve featuring four lengthwise opposed partial notches.

DETAILED DESCRIPTION OF THE PREFERRED EMBODIMENTS

Figure 10:
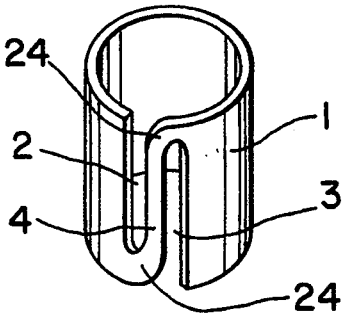
FIGS. 10 and 11 are perspective views of a closed sleeve support similar to that illustrated in FIGS. 1 to 4 featuring two opposed partial notches but having their inner portions curvilinearly formed with a radius that merges into the body of the sleeve.

With reference to FIGS. 1 to 4, the closed sleeve support 1 features, preferably on the side opposite the marking, two lengthwise opposed, partial notches 2, 3, so as to form an intermediate portion 4, one end of which is connected to one semicylinder and the other end to the other semicylinder of the sleeve.

The peripheral distance between the partial notches 2, 3 should preferably be small so that the intermediate portion 4 has a limited width and can be subjected to elastic deformation without appreciable deformation of the whole sleeve.

FIGS. 3 and 4 show that the sleeve 1, when fitted on the cable 5, is radially expanded due to widening of the notches 2 and 3, but in practice, the whole inner surface of the sleeve adheres to the outer cable surface, thus ensuring great stability against axial rotation as well as against longitudinal movements of the cable. These figures also show that the sleeve 1 can be fitted on cable 5, as well as on cable 6, although differently sized, because of the elastic widening of the notches 2, 3.

In the embodiments of FIG. 5 to 8, the closed sleeve support 7 has three lengthwise alternately opposed notches 8, 9, 10 generating two narrow intermediate portions 11 and 12, the first of which is connected at one end to one semicylinder of the sleeve, its other end being connected to the matching end of the second intermediate portion 12 which, in turn, is connected to the other end of the other semicylinder of the sleeve.

This embodiment featuring three consecutive partial notches, enables the same sleeve to fit on quite different sized cables 13, 14 causing expansion of the notches to a greater or smaller extent, this flexible expansion range being greater than for sleeves featuring only two notches.

A further embodiment is illustrated in FIG. 9 in which the closed sleeve 15 features four consecutive and lengthwise alternately opposed partial notches 16, 17, 18, 19 forming three narrow portions 20, 21, 22 which are Z-wise connected to each other and to the sleeve halves. This embodiment extends the possibility of installing the sleeve on differently sized cables without jeopardizing its above mentioned great stability on the cable.

The closed sleeve support according to the invention featuring two or more opposed partial notches thus meets the stability requirement due to the large contacting surfaces of the sleeve and cable and to the elastic deformation of the partial notches which permits the same support to be used for marking cables having different diameters.

Figure 11:
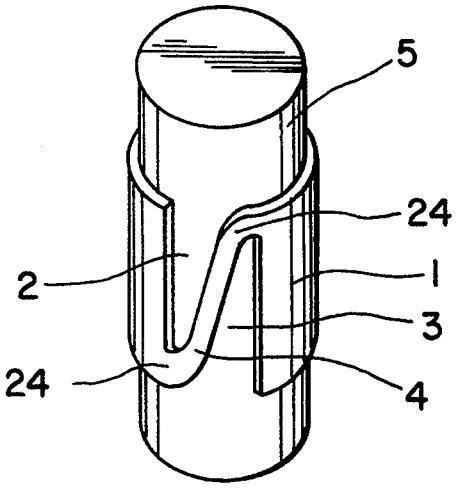
Figure 12:
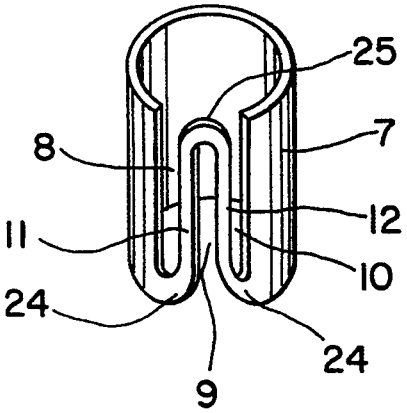
FIGS. 12 and 13 are perspective views of the sleeves of FIGS. 5 to 8, with three opposed partial notches but having their inner portions curvilinearly formed with a radius that merges into the body of the sleeve and connected to each other.
Figure 13:
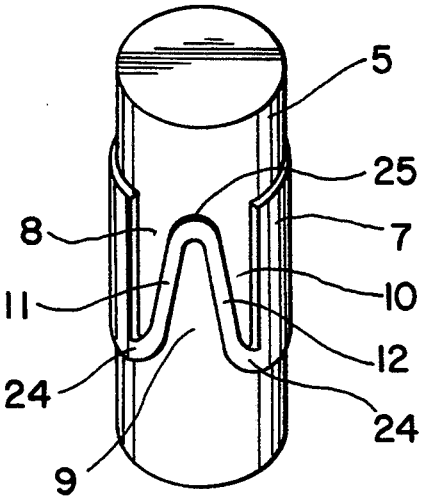

In FIGS. 1 to 9, the inner portions 4, 11, 12, 20, 21, and 22 are separated from the sleeve body and from each other by intersecting lines, generating well defined edges and angles. In the embodiments of FIGS. 10 to 13 the inner portions 24, 25 are curvilinearly formed with radii at their junction to the sleeve and to each other. The approach adopted in FIGS. 10 to 13 permits less elastic deformation of the sleeve but still ensures excellent stability on the cable and minimum dimensional requirements.

The sleeve support featuring partial notches may be used for known marking elements either preprinted on the sleeve, or on labels to be glued on the sleeve, or ring-shaped marking elements to be introduced into the recess 23 shown in phantom, in a manner known in the art.

According to the invention, the closed sleeve support can be formed of any material, usually plastic, and may be obtained by molding or extrusion. Obviously, extruded sleeves will require automatic notching and such sleeves must be cut to length.

The foregoing is a description of a preferred embodiment of the invention which is given here by way of example only. The invention is not to be taken as limited to any of the specific features as described, but comprehends all such variations thereof as come within the scope of the appended claims.

The embodiments of the invention in which an exclusive property or privilege is claimed are defined as follows:

1. A cable support for marking an electrical cable, comprising:

a closed, endless, cylindrical sleeve having a circular cross-section of a predetermined diameter and extending along, and about, a longitudinal axis, said sleeve having a body portion at one lateral side of said axis, said sleeve also having a notched connecting portion at another lateral side of said axis opposite to said one lateral side, said notched connecting portion being integral with the body portion and together having an interior circular surface that extends about said axis, said notched connecting portion being deformable relative to the body portion to permit radial expansion of the sleeve to a different circular cross-section having a different diameter greater than said predetermined diameter, and said sleeve including a plurality of notches extending along said axis solely at said notched connecting portion at said opposite lateral side of said axis, the notches being spaced away from said body portion at said one lateral side of said axis.

2. The cable support according to claim 1, wherein the sleeve has opposite end regions, and wherein a first of said plurality of notches extends from one of the end regions along said axis toward, and terminating short of, the other of the end regions, and wherein a second of said plurality of notches extends from the other end region along said axis toward, and terminating short of, said one end region.

3. The cable support according to claim 2, wherein the sleeve has a third notch extending from said one end region of the sleeve along said axis toward, and terminating short of, said other end region; and wherein the third notch is spaced from said first and second notches.

4. The cable support according to claim 3, wherein the connecting portion includes two elongated arms having arm ends integrally connected to the body portion, said arms being integrally connected to each other at a junction.

5. The cable support according to claim 4, wherein each arm end and the junction is bounded by angled edges.

6. The cable support according to claim 4, wherein each arm end and the junction is bounded by curved edges.

7. The cable support according to claim 3, wherein the sleeve has a fourth notch extending from said other end region of the sleeve along said axis toward, and terminating short of, said one end region; and wherein the fourth notch is spaced from said third notch.

8. The cable support according to claim. 7, wherein the connecting portion includes three elongated arms having arm ends integrally connected to the body portion, said arms being integrally connected to each other at two junctions.

9. The cable support according to claim 8, wherein each arm end and each junction is bounded by angled edges.

10. The cable support according to claim 8, wherein each arm end and each junction is bounded by curved edges.

11. The cable support according to claim 2, wherein the connecting portion is a single elongated arm having opposite arm ends integrally connected to the body portion.

12. The cable support according to claim 11, wherein each arm end is bounded by angled edges.

13. The cable support according to claim 11, wherein each arm end is bounded by curved edges.

14. The cable support according to claim 1, wherein the sleeve is constituted of an elastically-deformable material.

* * * * *